US005680972A

United States Patent [19]

Clarke

[11] Patent Number: 5,680,972

[45] Date of Patent: Oct. 28, 1997

[54] GARMENT HANGER SYSTEM

[76] Inventor: George Clarke, 520 7th St., Wilmette, Ill. 60091

[21] Appl. No.: 586,334

[22] Filed: Jan. 16, 1996

[51] Int. Cl.[6] ..... A47G 25/18; A47G 25/44; A47G 25/40

[52] U.S. Cl. ..... 223/88; 223/89; 223/94

[58] Field of Search ..... 223/85, 88, 89, 223/92, 94, 95

[56] References Cited

U.S. PATENT DOCUMENTS

| | | | |
|---|---|---|---|
| 1,344,665 | 6/1920 | Weber . | |
| 1,553,140 | 9/1925 | Chidley | 223/88 |
| 1,880,963 | 10/1932 | Kraft . | |
| 2,232,249 | 2/1941 | Losin . | |
| 2,360,119 | 10/1944 | Gallagher . | |
| 2,491,836 | 12/1949 | Simmet . | |
| 2,577,854 | 12/1951 | Marbit . | |
| 2,611,517 | 9/1952 | Simonsen | 223/88 |
| 2,673,668 | 3/1954 | Riddell | 223/89 |
| 2,718,340 | 9/1955 | Lundman | 223/88 |
| 2,804,245 | 8/1957 | Biondolillo et al. . | |
| 2,805,011 | 9/1957 | Ambrosino | 223/88 |
| 2,817,471 | 12/1957 | Stoschy . | |
| 2,904,233 | 9/1959 | Brothers . | |
| 3,005,579 | 10/1961 | Thurber . | |
| 3,039,662 | 6/1962 | Strong . | |
| 3,219,241 | 11/1965 | Newton . | |
| 3,531,028 | 9/1970 | Vazuez . | |
| 3,645,426 | 2/1972 | Glascock et al. . | |
| 3,695,492 | 10/1972 | Sheba . | |
| 4,114,786 | 9/1978 | Wiese | 223/94 |
| 4,117,960 | 10/1978 | Bengsch et al. | 223/94 |
| 4,221,310 | 9/1980 | Hazenveld | 223/94 |
| 4,334,641 | 6/1982 | Narcum | 223/94 |
| 4,586,637 | 5/1986 | Lemel | 223/92 |
| 4,738,381 | 4/1988 | Marcin | 223/88 |
| 4,877,163 | 10/1989 | Zimmerman | 223/93 |
| 4,905,877 | 3/1990 | Gatling | 223/89 |
| 4,932,571 | 6/1990 | Blanchard | 223/89 |
| 5,007,562 | 4/1991 | Bronk et al. | 223/89 |
| 5,029,739 | 7/1991 | Blanchard et al. | 223/88 |
| 5,044,534 | 9/1991 | Hwang | 223/94 |
| 5,044,535 | 9/1991 | Hunt | 223/88 |
| 5,082,152 | 1/1992 | Chen | 223/89 |
| 5,145,098 | 9/1992 | Tung | 223/94 |
| 5,476,199 | 12/1995 | Halverson et al. | 223/89 |

*Primary Examiner*—Bibhu Mohanty

[57] ABSTRACT

A wardrobe hanger system having a first, upper section for suspending coats, jackets, shirts, and the like, and for suspending slacks or pants, and a second, detachable lower section for suspending a skirt, or the like. The second, lower section holds the skirt, by means of a pair of spring-biassed, extensible arms. The lower section is attached to the upper section by means of a cooperating tongue-and-groove connection. Tabs at the ends of the runner of the upper section prevent the lower section from escaping from the upper section until one of the tabs is depressed, allowing the lower section's runner to clear past the tab, and to therefore, be removed from the upper section. When the lower section is detached from the upper section, it may be used separately and independently of the upper section.

9 Claims, 8 Drawing Sheets

GARMENT HANGER SYSTEM

BACKGROUND OF THE INVENTION

The present invention is directed to a hanger system for hanging, or suspending garments, and, in particular, to the hanging of complete suits or outfits.

It is known to provide complex clothes hangers, which are comprised of detachable parts or sections, whereby one part may be used for hanging an outer garment such as a shirt or jacket, and whereby the other part may be used for suspending a pair of pants or skirt. An example of such a system are shown in U.S. Pat. Nos. 2,804,245 and 4,905,877. The present invention is directed to such a multiple-part, detachable hanger system, where the two sections of the hanger system are easily connected and disconnected from each other, but are securely prevented from accidental separation.

SUMMARY OF THE INVENTION

It is the primary objective of the present invention to provide a dual-sectioned, detachably-arranged clothes hanger that may be used for suspending an entire wardrobe, from, for example, a tank top, belt, suit, tie and coat, and the like.

It is also a primary objective of the present invention to provide such a hanger system that allows the two sections of the hanger to be easily separated from each other, so that each section may be used separately and independently of the other.

Toward these and other ends, the clothes hanger system of the invention consists of a first, upper section for suspending coats, jackets, shirts, and the like, and for suspending slacks or pants, and a second, detachable lower section for suspending a skirt, or the like. The second, lower section holds the skirt, or the like, via the interior waist band of the skirt, by means of a pair of spring-biassed, extensible arms. The lower section is attached to the upper section by means of a cooperating tongue-and-groove connection. Tabs at the ends of the runner of the upper section prevent the lower section from escaping from the upper section until one of the tabs is depressed, allowing the lower section's runner to clear past the tab, and to therefore, be removed from the upper section. When the lower section is detached from the upper section, it may be used separately and independently of the upper section.

BRIEF DESCRIPTION OF THE DRAWING

The invention will be more readily understood with reference to the accompanying drawing, wherein.

DETAILED DESCRIPTION OF THE INVENTION

Figure 1:
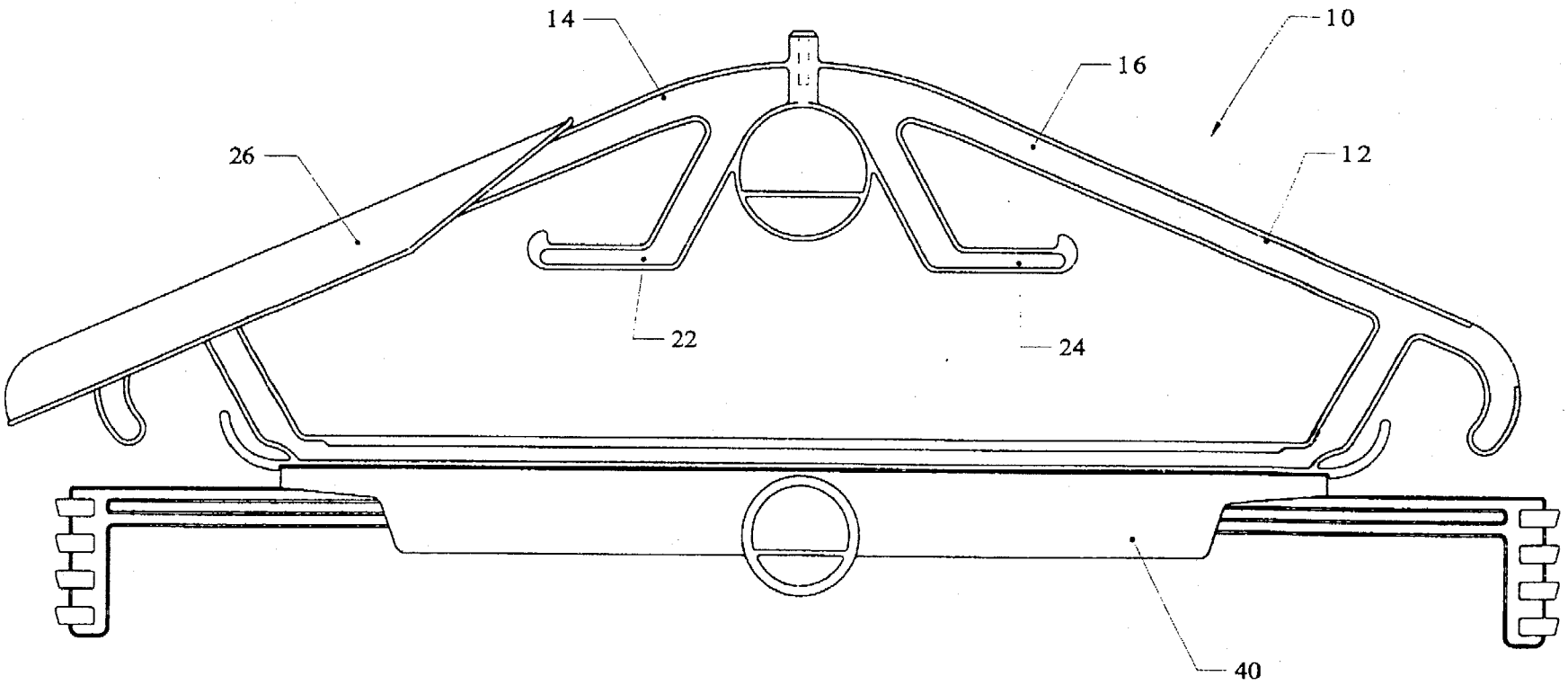
FIG. 1 is a plan view showing the two sections of the clothes hanger system of the invention attached together for suspending an entire wardrobe.
Figure 2:
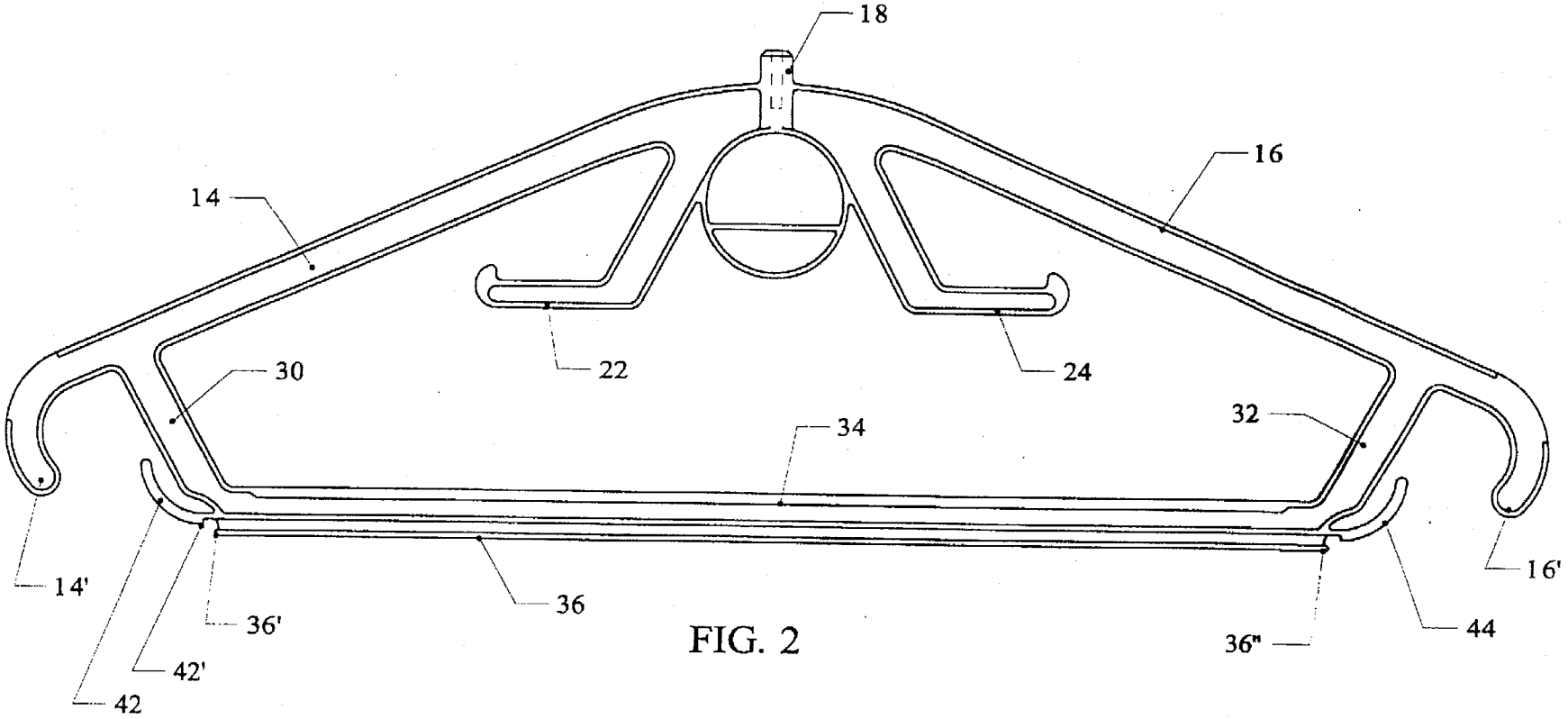
FIG. 2 is a plan view of the first, upper section detached from the lower section.
Figure 3:
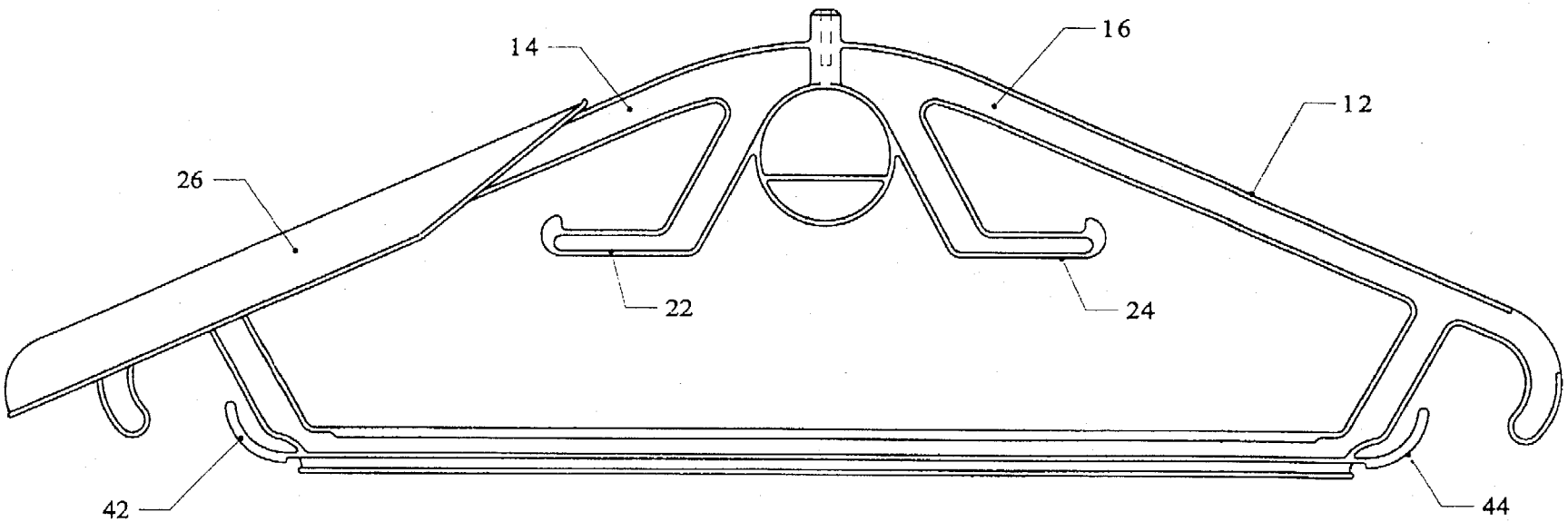
FIG. 3 is a plan view of the first, upper section of FIG. 2 showing the use of an extensible shoulder section therewith.
Figure 4:
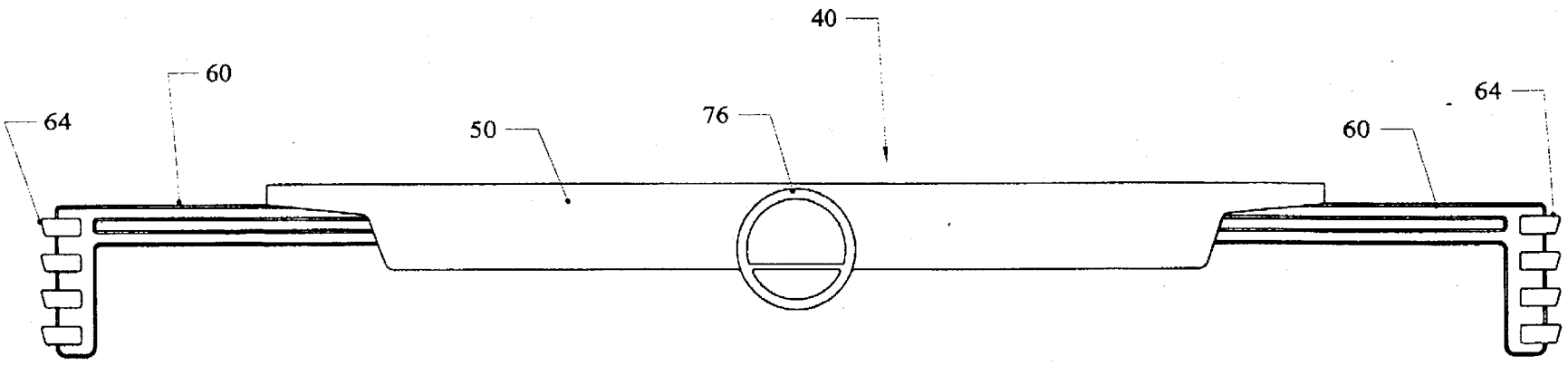
FIG. 4 is a plan view of the second, lower section detached from the upper section.
Figure 10:
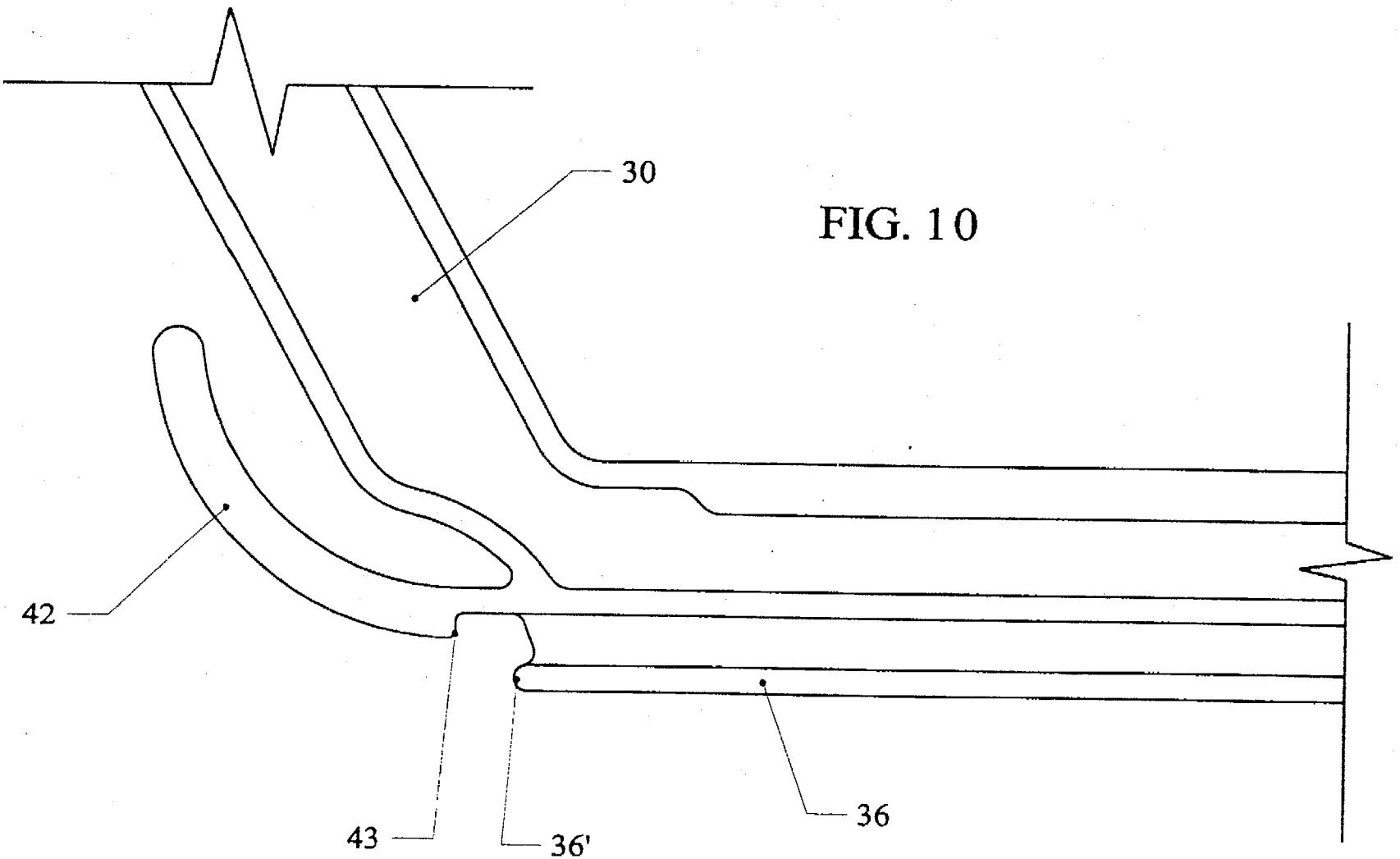
FIG. 10 is an enlarged detail view showing the detent tabs on the upper section for releasably securing the lower section to the upper section.
Figure 11:
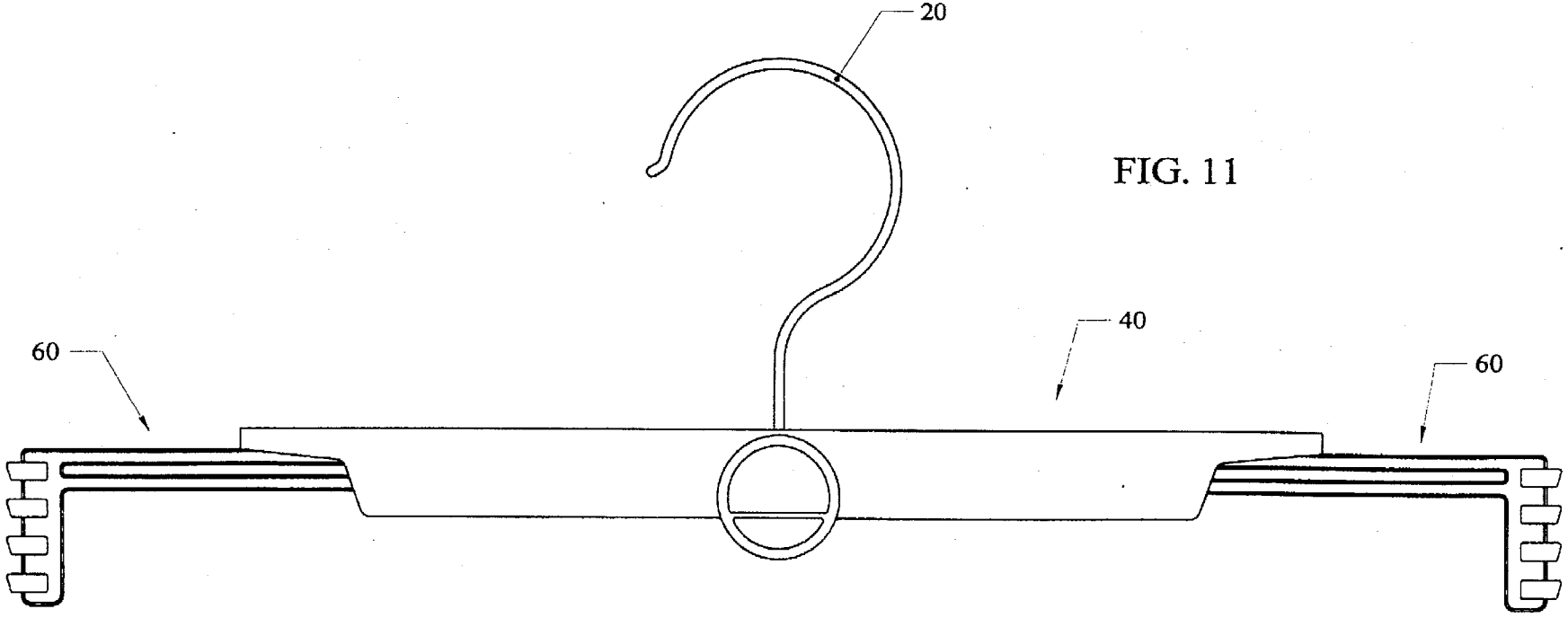
FIG. 11 is a plan view showing the second section detached from the upper section and ready for separate and independent use by the insertion of a wire loop through the central opening thereof.

Referring now to the drawings in greater detail, where like reference numerals indicate like parts, the wardrobe hanger system is indicated generally by reference numeral 10, and includes an upper, draping section 12 for coats, jackets, shirts, and the like. The upper section 12 is made of a thermoplastic resin material, and, as best seen in FIGS. 1–3, includes oppositely sloping shoulder portions 14, 16, which terminate in inwardly and downwardly projecting hooked portions 14', 16', respectively, which hooked portion may be used for mounting and storing jewelry items thereon. The transition from the shoulder portion 14, 16 to a hooked portion 14', 16' is smooth and arcuate in order to avoid sharp edges that may be entangle a garment or prevent its easy sliding off from the shoulder portions. The upper section 12 also has a central shaft opening 18 for receiving a conventional wire suspending hook element 20 (see FIG. 11), by which the wardrobe hanger system may be suspended from a rack or the like. Projecting interiorly from the shoulder portions are a pair of right-angle hooks 22, for integrally with the shoulder portions, for use in hanging a tie or other small, auxiliary clothing items. As seen in FIG. 1 and 3, there may also be provided extensible, shoulder-adjusting sections 26 which is adjustably positionable along a shoulder portion 14, 16, in order to vary the overall length of the each shoulder portion. The adjustable extensible, shoulder-adjusting sections 26 are optional, and may be provided in different colors. The upper section 12 is made of I-beam construction, with the extensible, shoulder-adjusting sections 26 having a an appropriate channel for sliding engagement along a respective shoulder portion 14, 16, in a manner described more fully hereinbelow with regard to the sliding connection between the upper section 12 and the lower section. Also projecting integrally from the shoulder portions 14, 16 are a pair of angular support pieces 30, 32 located near the ends of the respective shoulder portions 14, 16, but before the formation of the inwardly and downwardly projecting hooked portions 14', 16'. The bottom edge-surfaces of these angular support pieces 30, 32 support a horizontal cross rail 34 which may be used for draping pants over. Protruding from the undersurface of the rail 34 is a tongue or slide 36 that is used for removably mounting the lower section 40 of the hanger 10, as described hereinbelow. The tongue or slide 36 is also formed integral with the rail 34, and is also of an I-beam cross section. As can be seen in FIGS. 2 and 3, each end 36', 36" of the slide 36 is accessible and open from the end, so that the lower section 40 may easily slid onto the slide 36 from either end. Operatively associated with the ends 36'36" of the slide are a pair of integral, resilient detent tabs 42, 44 that are used for retaining the lower section in place on the upper section. Toward these ends, each tab 42, 44 is pivotally connected by a living hinge 42' to an end-portion cross rail 34. The living hinge defines a narrower or reduced-thickness section that allows the tab 42, 44 to be rotated or pivoted thereabout. Thus, one may depress the detent tab 42 or 44 by pushing up on the tab, such that the tab 42 will rotate in the clockwise direction when viewing FIG. 2, while the tab 44 will rotate in the counterclockwise direction. Such upward depression of either tab causes the respective end of the rail to be freely and unobstructedly accessible, so that the lower section may be readily attached or detached from the tongue 36. That is, as either of the tabs 42, 44 is rotated and lifted by pressing upwardly thereon with a finger, a detent stop 43 (see FIG. 10) adjacent the living hinge 42' is moved out of the way or path of the lower section's channel that is used for mounting the lower section to the upper section, whereby clearance is thereby achieved to allow the channel section of the lower section to be slid off from the tongue 36, in the case where the lower section is being removed from the upper section, or, alternatively, the channel section of the lower section 40 may clear past the detent stop 43 in order to mount the lower section to the upper section.

Figure 5:
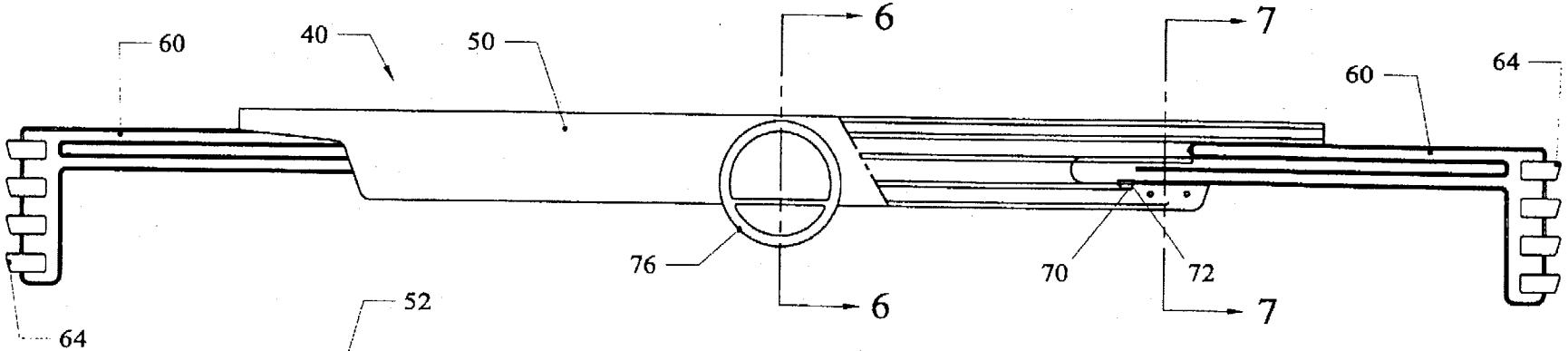
FIG. 5 is a plan view of the second lower section, with a portion thereon broken away to show the sliding connection of the extensible arm within the main frame of the second section.
Figure 7:
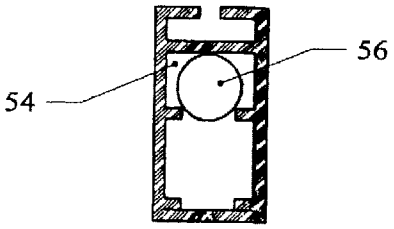
FIG. 7 is a cross-sectional view taken along line 7—7 of FIG. 5.
Figure 6:
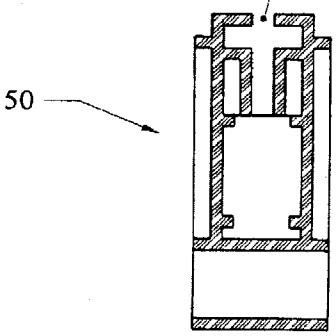
FIG. 6 is a cross-sectional view taken along line 6—6 of FIG. 5.
Figure 8:
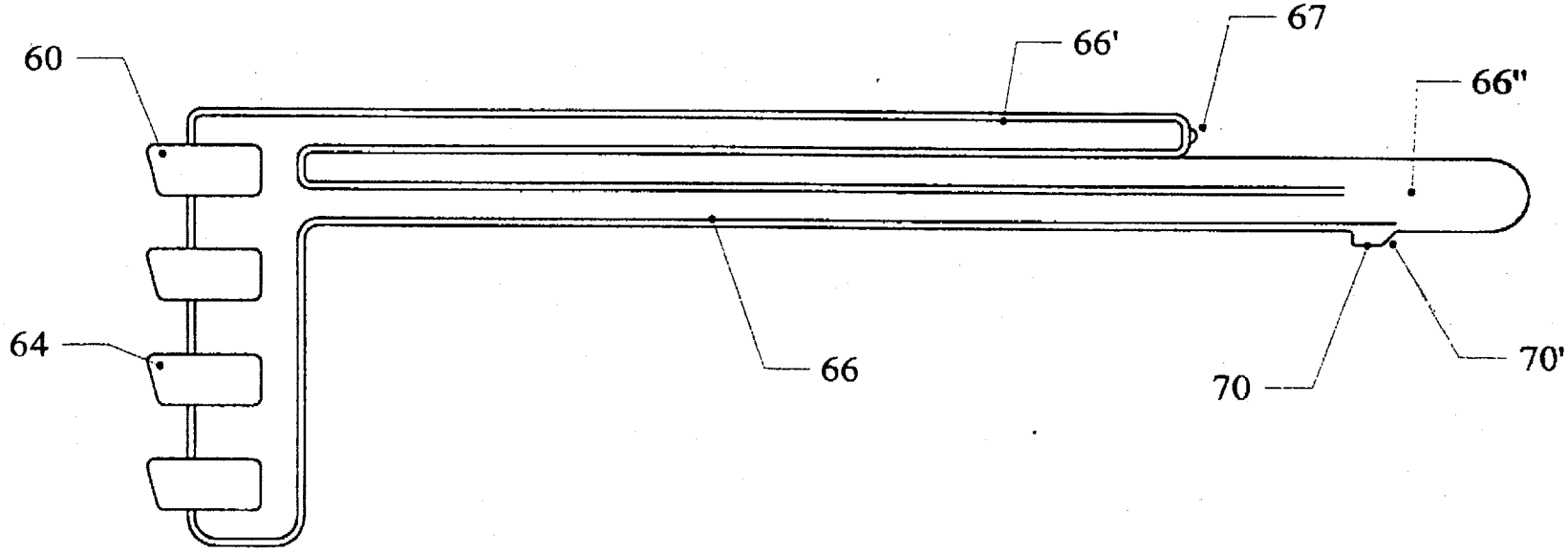
FIG. 8 is a detailed plan view of an extensible arm for the lower section.
Figure 9:
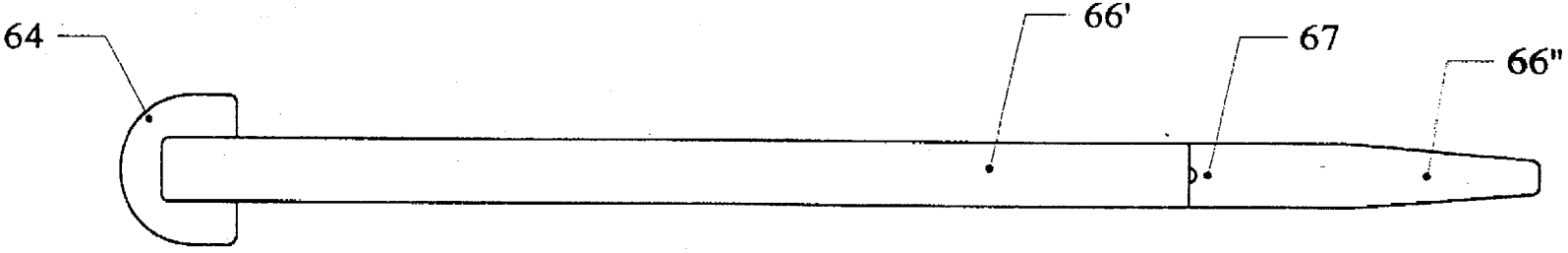
FIG. 9 is a side view of the extensible arm for the lower section of FIG. 8.

Referring now to FIGS. 1 and 4–10, the lower hanger section 40 is shown in detail. The lower hanger section 40 is shown in detail. The lower hanger section 40 is also made of thermoplastic resin material, and includes a main body portion 50 made of one integral piece of plastic, and which has an upper groove or channel section 52 (FIG. 6) which slidingly receives therein the tongue or slide 36 of the upper hanger section, whereby the lower hanger section may be removably mounted to the upper hanger section. The main body portion 50 also defines an interior cavity or runner 54 (FIG. 7) that extends from each lateral side of the main body portion. Within the interior cavity 54 is a pair of compression springs 56, one for each lateral side of the main body portion. Slidingly mounted in the lateral interior cavities or runners 54 are a pair of extensible arms or tensioning members 60. Each arm 60, as best seen in FIGS. 8 and 9, is made of one-piece plastic, and has an end-gripping section 62 comprised of a plurality of tapering prongs or tips 64, which prongs, when biassed outwardly, grip the interior waist band of a skirt positioned thereabout. Extending from the end-gripping section 62 is a main shaft 66 that is L-shaped, in order to define a shorter section 66' and a longer section 66". The shaft 66 rides or slides in a runner or interior cavity 54, and is spring-biassed outwardly by a compression spring 56 acting against, and encircling, an end-projection 67 protruding from the end of the shorter section 66' of the main shaft 66 (FIG. 8). The underside of the longer section 66" has a downwardly-projecting detent or tab 70 that prevents the sliding main shaft 66 from escaping out of the interior cavity 54, which tab 70 cooperates with a similarly-shaped tab or detent 72 located on the interior surface of the interior cavity 54, as seen in FIG. 5. The tab 70 is provided with an canted or sloped surface 70' in order to allow for assembly or insertion of the tensioning member 60 in a respective interior cavity 54.

The main body portion 50 of the lower hanger section is also provided with a central socket 76 having a through-opening, by which, if desired, the wire suspension hook member 20 may be inserted (FIG. 11), whereby the lower hanger section 40 may be used separately and independently of the upper section, and used to hang a skirt by itself.

While a specific embodiment of the invention has been shown and described, it is to be understood that numerous changes and modifications may be made therein without departing from the scope, spirit and intent of the invention as set forth in the appended claims.

What I claim is:

1. A dual-part wardrobe hanger system, comprising:

a first, upper hanger section having a main frame comprising a pair of shoulder-support sections for supporting a garment thereon, and a cross rail that may be used for suspending a garment such as pants;

said first, upper hanger section also comprising mounting means projecting from said cross rail for removably mounting a second, lower hanger section to said first, upper hanger section;

a second, lower hanger section removably detachable to said first, upper hanger section by means of said mounting means, said second, lower hanger section having cooperating means for detachably mounting said second, lower hanger section to said first, upper hanger section;

said mounting means comprising detent means for preventing said second, lower hanger from accidentally separating from said first, upper section;

said detent means comprises at least one pivotal element having a stop that is moved out of the way of said second, lower hanger section when said at least one pivotal element is pivoted.

2. The dual-part wardrobe hanger system according to claim 1, wherein said mounting means and said cooperating means comprise a tongue-and-groove sliding connection, whereby said second, lower hanger section may be slid onto and off from the first, upper hanger section.

3. The dual-part wardrobe hanger system according to claim 2, wherein said detent means comprises a pair of pivotal elements each having a stop that is moved out of the way of the sliding cooperating means of said second, lower hanger section when said pivotal element is pivoted, one said pivotal element being located adjacent an end of said tongue-and-groove connection.

4. The dual-part wardrobe hanger system according to claim 1, wherein said second, lower hanger section comprises a main body portion having an interior cavity, biassing means positioned in said interior cavity, and at least one extensible gripping arm section having a main shaft mounted for sliding movement in said interior cavity and biassed laterally outwardly by said biassing means, whereby said at least one extensible gripping arm section suspends a skirt, or the like, at the interior waist band thereof.

5. The dual-part wardrobe hanger system according to claim 4, comprising a pair of laterally-oppositely mounted extensible gripping arm sections each having a main shaft mounted for sliding movement in said interior cavity and biassed laterally outwardly by said biassing means, whereby said pair extensible gripping arm section suspends a skirt, or the like, at the interior waist band thereof.

6. The dual-part wardrobe hanger system according to claim 4, wherein said main shaft of said at least one extensible gripping arm section comprises a shorter section against which said biassing means abuts, and a longer section having detent means cooperating with said interior cavity for preventing said main shaft from escaping from said interior cavity.

7. A dual-part wardrobe hanger system, comprising:

a first, upper hanger section having a main frame comprising a cross rail that may be used for suspending a garment such as pants;

said first, upper hanger section also comprising mounting means projecting from said cross rail for removably mounting a second, lower hanger section to said first, upper hanger section;

a second, lower hanger section removably detachable to said first, upper hanger section by means of said mounting means, said second, lower hanger section having cooperating means for detachably mounting said second, lower hanger section to said first, upper hanger section;

said second, lower hanger section comprising a main body portion having an interior cavity, biassing means positioned in said interior cavity, and at least one extensible gripping arm section having a main shaft mounted for sliding movement in said interior cavity and biassed laterally outwardly by said biassing means, whereby said at least one extensible gripping arm section suspends a skirt, or the like, at the interior waist band thereof.

8. The dual-part wardrobe hanger system, according to claim 7, comprising a pair of laterally-oppositely mounted extensible gripping arm sections each having a main shaft mounted for sliding movement in said interior cavity and biassed laterally outwardly by said biassing means, whereby said pair of extensible gripping arm sections suspends a skirt, or the like, at the interior waist band thereof.

9. The dual-part wardrobe hanger system, according to claim 7, wherein said main shaft of said at least one extensible gripping arm section comprises a shorter section against which said biassing means abuts, and a longer section having detent means cooperating with said interior cavity for preventing said main shaft from escaping said interior cavity.

* * * * *